US006112471A

United States Patent [19]

Welch et al.

[11] Patent Number: 6,112,471

[45] Date of Patent: Sep. 5, 2000

[54] ADAPTER FOR MOUNTING STRIKE WITHIN CAVITY OF DOOR ARRANGEMENT

[75] Inventors: Tom E. Welch, Wolsey; Timothy A. Browne, Huron, both of S. Dak.

[73] Assignee: United Dominion Industries, Inc., Charlotte, N.C.

[21] Appl. No.: 09/358,073

[22] Filed: Jul. 21, 1999

[51] Int. Cl.[7] ..... E06B 3/00

[52] U.S. Cl. ..... 49/503; 70/451; 292/DIG. 53

[58] Field of Search ..... 49/503, 394; 292/DIG. 53, 292/DIG. 54; 70/448, 451, 466

[56] References Cited

U.S. PATENT DOCUMENTS

| | | | |
|---|---|---|---|
| 1,423,825 | 7/1922 | Anderson | 70/451 |
| 2,417,167 | 3/1947 | Johnston . | |
| 2,653,843 | 9/1953 | Adams et al. . | |
| 3,702,549 | 11/1972 | Solovieff et al. | 70/451 X |
| 3,740,979 | 6/1973 | Crepinsek | 70/451 X |
| 3,768,284 | 10/1973 | Kent et al. . | |
| 3,971,239 | 7/1976 | Lavis . | |
| 4,139,999 | 2/1979 | Allenbaugh . | |
| 4,887,856 | 12/1989 | Percoco et al. | 292/DIG. 53 X |
| 4,982,528 | 1/1991 | Michel . | |
| 5,040,393 | 8/1991 | Rossebo | 292/DIG. 53 X |
| 5,241,787 | 9/1993 | Norman . | |
| 5,299,385 | 4/1994 | McConnell . | |
| 5,335,525 | 8/1994 | Solovieff . | |
| 5,435,159 | 7/1995 | Ramsauer . | |
| 5,487,287 | 1/1996 | Viggiano . | |
| 5,560,234 | 10/1996 | Ross et al. . | |
| 5,606,880 | 3/1997 | Viggiano . | |

OTHER PUBLICATIONS

"Universal Lock" details document.

*Primary Examiner*—Jerry Redman

*Attorney, Agent, or Firm*—Kennedy Covington Lobdell & Hickman, LLP

[57] ABSTRACT

A prison door arrangement includes a cavity formed in a side edge of a door; an adapter releasably secured to the door and extending within the cavity; and a strike disposed within the cavity and releasably secured to the adapter. A method for installing a strike within a cavity formed in a side edge of a door of a prison door arrangement includes selecting one of a plurality of different strikes, each strike dimensioned to fit completely within the cavity; based on the selection of the strike, selecting one of a plurality of adapters, each adapter designed to receive one of the strikes; and releasably securing the selected adapter to the door such that the adapter extends within the cavity, and mounting the selected strike within the cavity by releasably securing the strike to the adapter.

17 Claims, 8 Drawing Sheets

ADAPTER FOR MOUNTING STRIKE WITHIN CAVITY OF DOOR ARRANGEMENT

FIELD OF THE PRESENT INVENTION

The present invention generally relates to the mounting of strike assemblies in door arrangements and, in particular, to the mounting of a strike in a prison door arrangement.

BACKGROUND OF THE PRESENT INVENTION

Currently, manufacturers of prison door arrangements, i.e., the door itself and the doorframe, must know in advance what lock mechanism and corresponding strike a customer intends to install in a door arrangement before the prison door arrangements can be delivered to the customer and installed. This requirement arises because the various lock mechanisms and strikes available in the marketplace for prison doors do not have standard sizes and/or configurations; such differences in strikes include the fastener locations for securement to a door and the particular locations of apertures for receiving bolts and latches of the lock mechanism. Consequently, each door and doorframe of a door arrangement must be manufactured with the particular lock mechanism and strike to be used in mind.

As a result of the increasing rapidity of construction and the ever increasing need for prison facilities, manufacturers of prison doors often are placed in the position of having to withhold delivery of door arrangements pending final selection of the lock mechanisms and corresponding strikes to be used, resulting in delays in the construction process. A need therefore exists by which door arrangements can be manufactured, delivered to the customer, and even installed by the customer, without having first selected which particular strike available in the marketplace will be used.

SUMMARY OF THE PRESENT INVENTION

The present invention permits manufacturers of prison door arrangements to manufacture, deliver, and install a prison door arrangement without the requirement that a particular strike first be selected. Briefly described, the present invention includes a door arrangement in which a door includes a cavity formed in a side edge thereof; an adapter releasably secured to the door and extending within the cavity; and a strike disposed within the cavity and releasably secured to the adapter. In a feature of the present invention, the dimension of the strike is less than the dimension of the cavity in a direction parallel to opposed walls and a side wall of the door.

The present invention also includes the corresponding method of installing a strike within a cavity formed in a side edge of a door, namely, selecting one of a plurality of different strikes, each strike dimensioned to fit completely within the cavity; based on the selection of the strike, selecting one of a plurality of adapters, each adapter designed to receive one of the strikes; and releasably securing the selected adapter to the door such that the adapter extends within the cavity, and mounting the selected strike within the cavity by releasably securing the strike to the adapter. In a feature of this method, the plurality of strikes each differ in their dimension extending parallel to the opposed walls and side wall of the door. In a further feature of this method, a step of installing the door in a building structure precedes the step of selecting the strike.

A benefit of the present invention Is that a different strike may be substituted for an original strike during the life cycle of the building if a different locking mechanism is later utilized.

BRIEF DESCRIPTION OF THE DRAWINGS

Further features, embodiments, and advantages of the present invention will become apparent from the following detailed description with reference to the drawings, wherein.

DETAILED DESCRIPTION OF PREFERRED EMBODIMENTS

Figure 1:
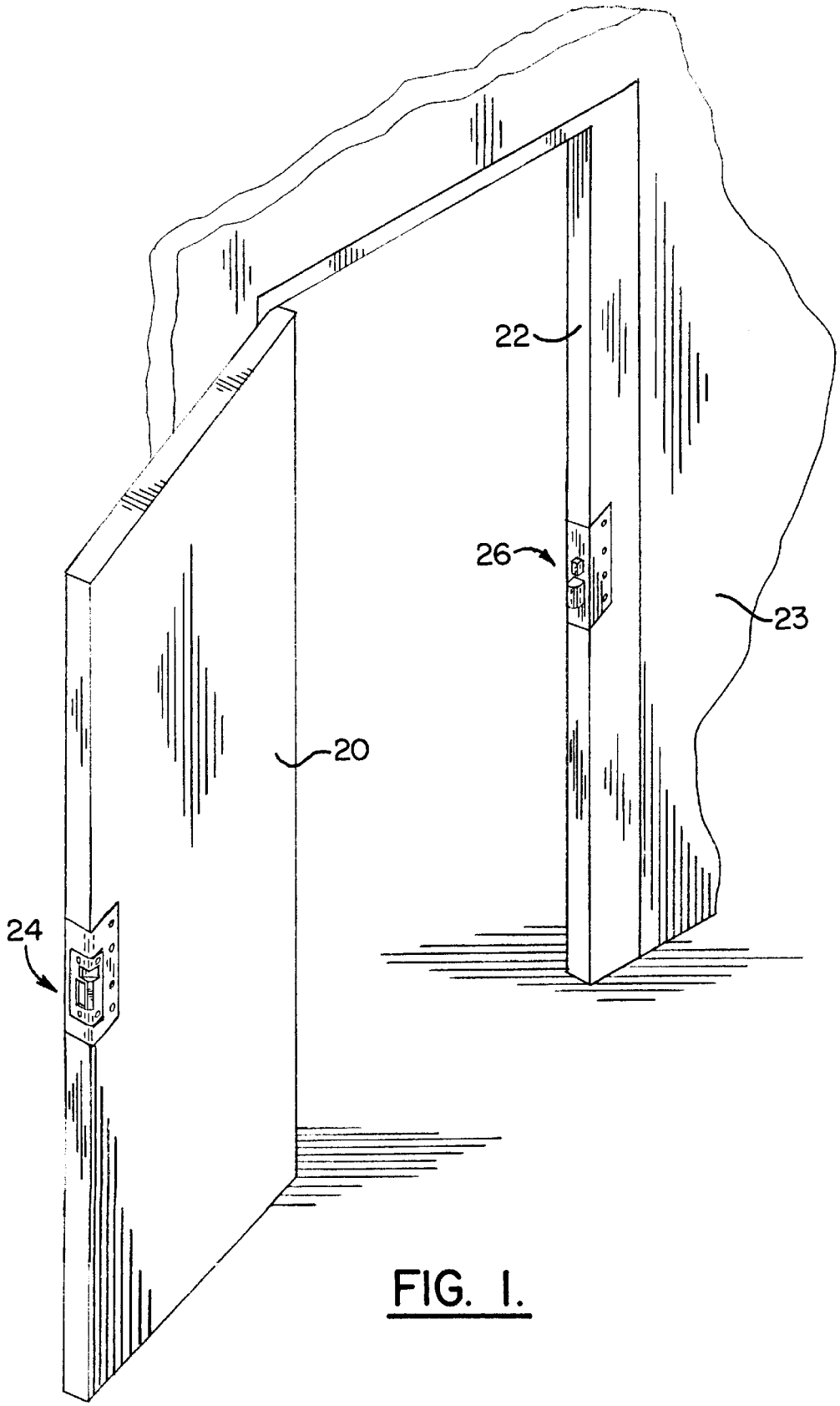
FIG. 1 is a perspective view of a prison door arrangement of the present invention.

Preferred embodiments of the present invention will now be described in detail with reference to FIGS. 1–10, wherein like structures are identified by like reference numerals.

A prison door arrangement is shown in FIG. 1 and includes two basic components—a door 20 and a doorframe 22—mounted into a prison cell wall 23. A strike assembly 24 generally is secured within a cavity of the door 20 and a lock assembly 26 generally is secured within a cavity of the doorframe 22.

Figure 2:
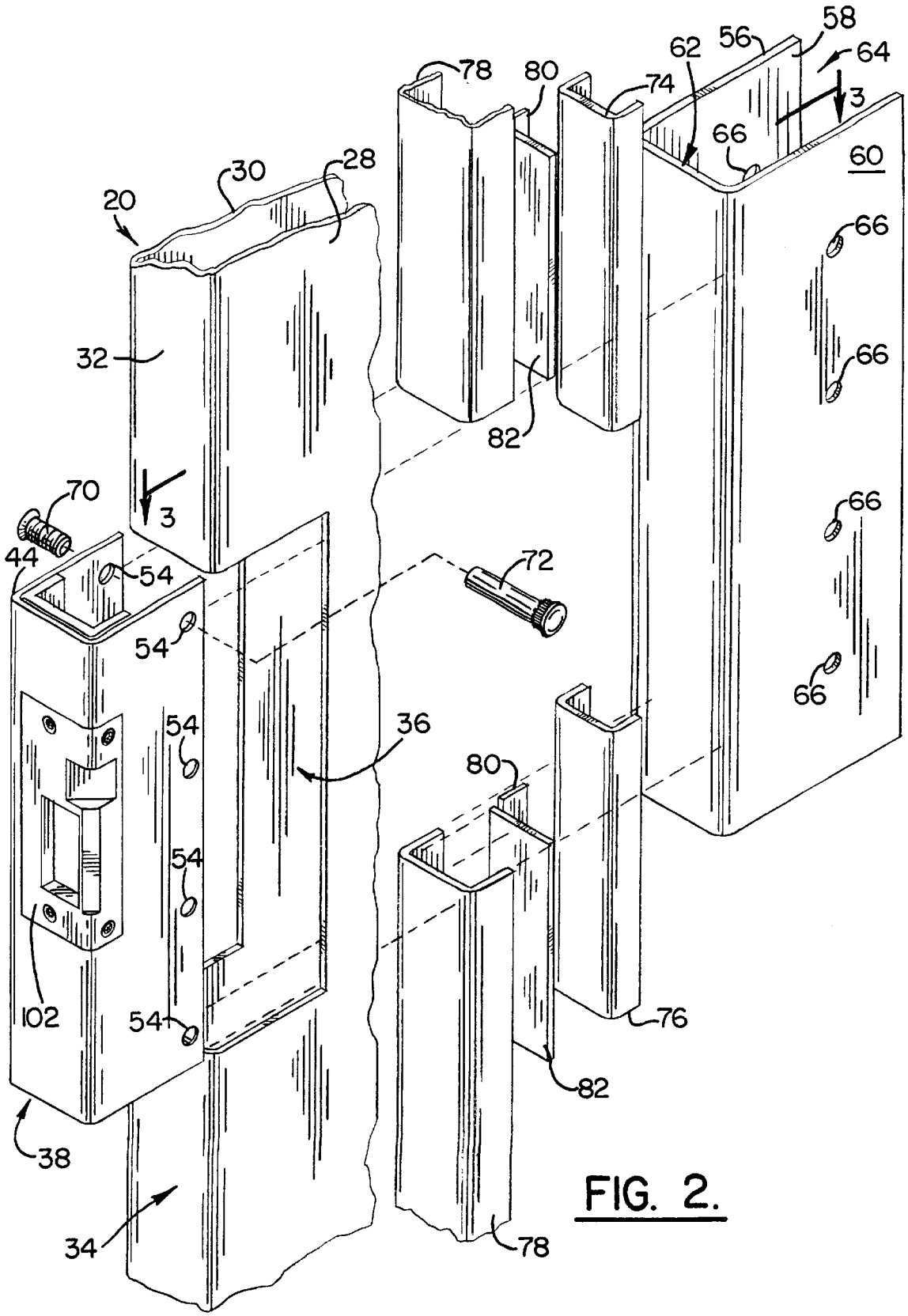
FIG. 2 is an exploded perspective view, partially broken away, of a door including an insert of the present invention.
Figure 3:
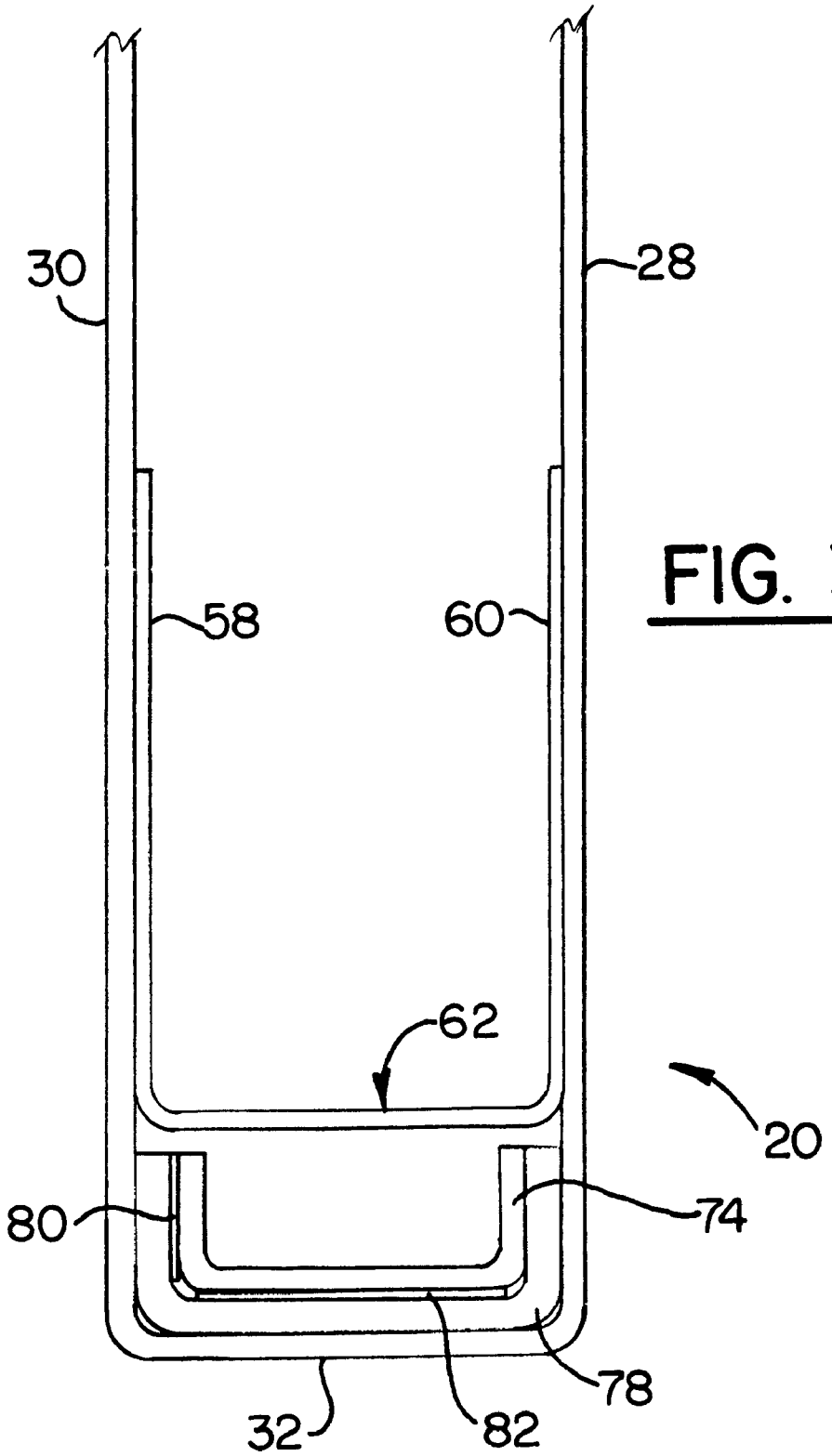
FIG. 3 is a plan view in cross-section of the door of FIG. 2 without the insert of the present invention taken along the line 3—3.
Figure 4:
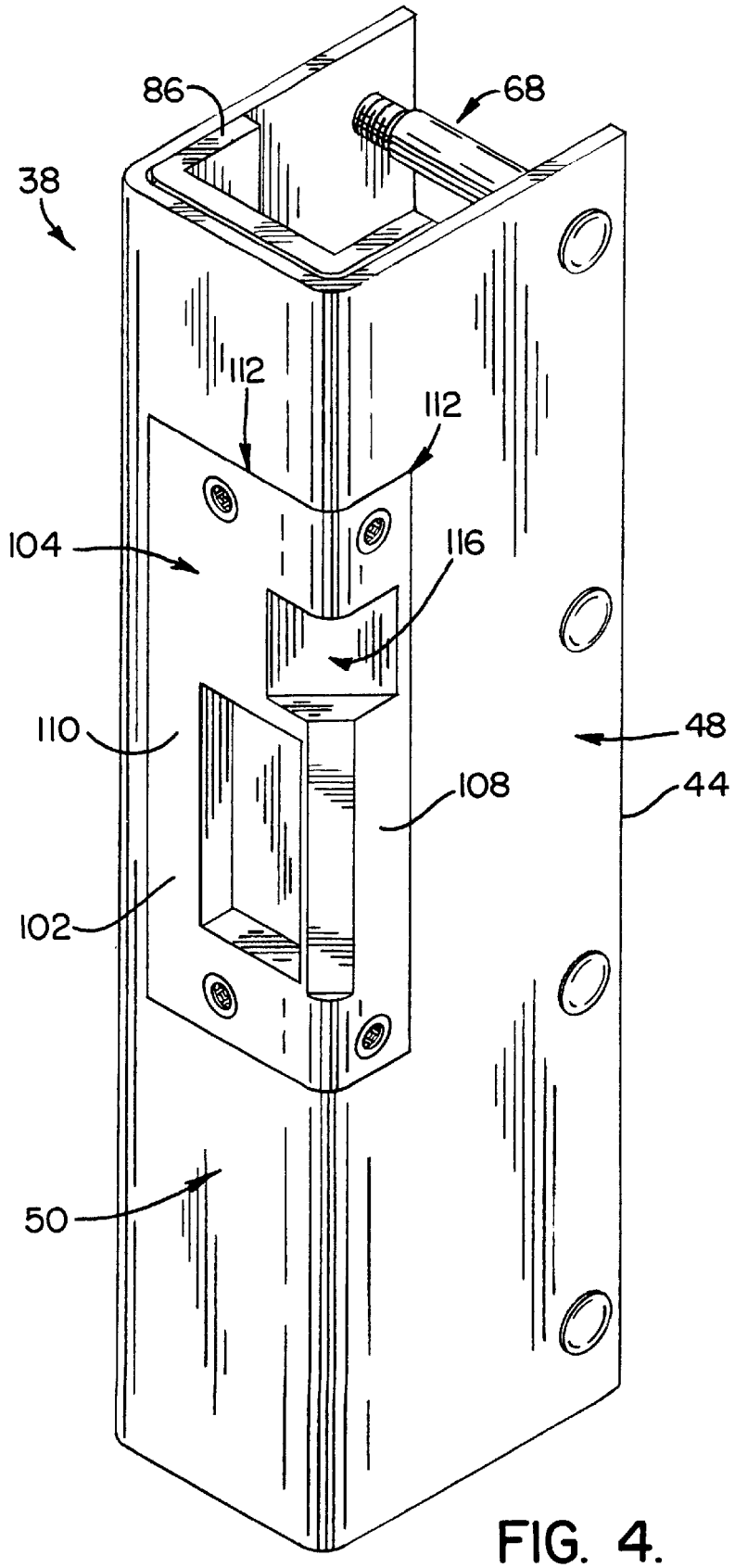
FIG. 4 is a perspective view of the insert of FIG. 2.
Figure 5:
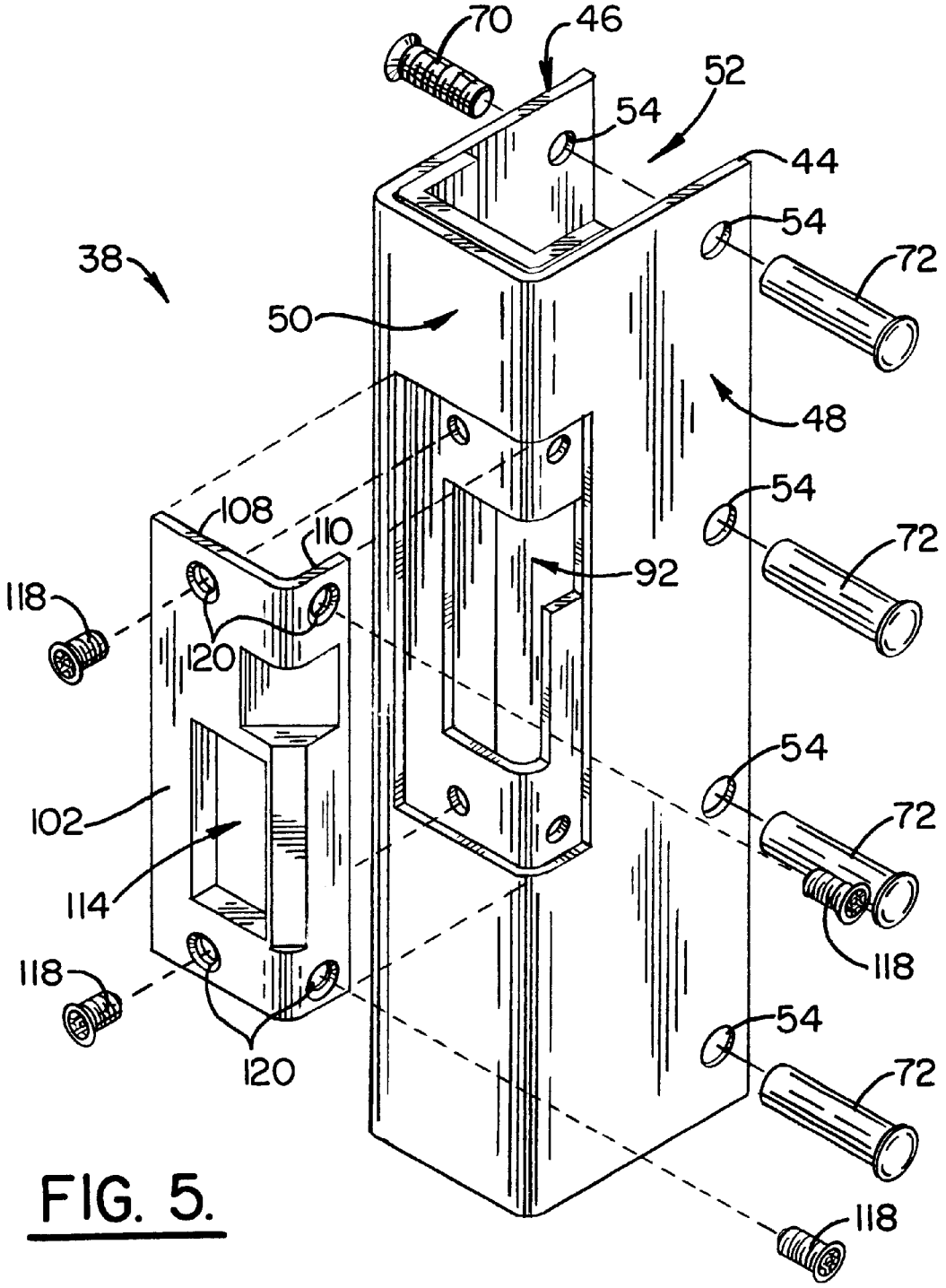
FIG. 5 is an exploded perspective view of the insert of FIG. 2.

As shown in FIG. 2, the door 20 having the strike assembly 24 of the present invention preferably includes opposed walls 28,30 and at least one side wall 32 joining the two walls 28,30 together along a side edge 34 of the door 20, whereby the door 20 is generally U-shaped in cross-section along the side edge 34. A cavity 36 is formed in the door 20 along the side edge 34 and, preferably, is formed by a simple cutout in the opposed walls 28,30 and side wall 32 to form a rectangular recess. The dimensions of the cavity 36 are standardized to predetermined values such that a wide variety of conventional strikes available in the marketplace can be fully disposed within the cavity 36.

In particular detail, the cavity 36 of the present invention is considered a "universal" cavity, since the cavity 36 is formed to predetermined dimensions such that any one of a plurality of different strikes can be disposed fully within the cavity 36. Specifically, many strikes are manufactured within the industry for use with prison doors. While many of these strikes have similar dimensions and are similarly configured for receiving a bolt from a corresponding locking mechanism, and are thus interchangeable to various degrees, some strikes do differ so significantly in size and/or configuration so as to be non-interchangeable. By forming a cavity in the door having predetermined dimensions sufficient to completely retain therein most, if not all, of these various strikes, the door arrangement of the present invention is able to accommodate a wide variety of strikes. Consequently, the door itself need not be custom manufactured for any particular strike selected and, in fact, the actual selection of the particular strike to be used need not be made prior to the actual installation of the door and doorframe. Instead, the selection of the strike can be made after shipment and/or installation of the doors in accordance with the present invention.

In order to mount such a wide variety of strikes within the cavity 36 of the door 20, the present invention includes a plurality of adapters, each adapter being adapted for releasable securement to the door 20 and extending within the cavity 36 and, further, each adapter being adapted for releasably securing a particular conventional strike within the cavity 36. Of course, the particular strike selected will determine the particular adapter of the present invention used, each adapter of the present invention being specifically designed to retain a particularly-sized and particularly-arranged strike within the standardized cavity 36 of the present invention.

Moreover, the strike first can be secured to the adapter and then the adapter secured to the door or, alternatively, the adapter first can be secured to the door and then the strike secured to the adapter. In either case, the combination of the adapter and strike together is referred to hereinafter as "insert." In this regard, a first preferred insert 38 of the present invention is shown, for example, in FIG. 4; a second preferred insert utilizes the adapter 40 shown in FIG. 9; and a third preferred insert 42 utilizes the adapter shown in FIG. 10.

With particular regard to the first preferred insert 38, the adapter thereof is shown in FIGS. 2–5 and includes a cover member comprising a cover plate 44 having first and second side sections 46,48 joined by an intermediate section 50 to form a U-shaped channel 52. The first and second side sections 46,48 and intermediate section 50 are dimensioned to fit within the rectangular cutout forming the cavity 36 in the door 20 whereby planar outer surfaces of the first and second walls 28,30 and side wall 32 of the door 20 meet in respective coplanar relation with the first and second side sections 46,48 and intermediate section 50 to maintain the continuity of the outer surfaces of the walls 28,30,32 of the door 20. In other words, the insert 38 is secured to the door 20 so that the adapter and strike of the insert are in relatively flush disposition with the outer surfaces of the walls 28,30, 32 of the door 20.

The cover plate 44 is supported within the cavity 36 by attachment of the side sections 46,48 to the door 20. In particular, each side section 46,48 includes four apertures 54 which respectively register with four apertures 54 in the other side section. The door 20 includes a mounting member comprising a mounting plate 56 having first and second side sections 58,60 and an intermediate section 62 shaped to form a U-shaped channel 64, and each side section 58,60 includes four apertures 66 disposed in registry with the apertures 54 in side sections 46,48 of the cover plate 44. The mounting plate 56 extends across the backside of the cavity 36 parallel to the side wall 32 and is welded to the inside of the side walls 28,30 of the door 20.

The first and second side sections 58,60 of the mounting plate 56 are spaced a distance apart conforming to the spacing between the side sections 46,48 of the cover plate 44 of the adapter, whereby each side section 46,48 of the adapter is disposed in abutment with the side sections 58,60 of the mounting plate 56. Bolt elements 68 (see FIG. 4) releasably secure the adapter in this position. Specifically, male bolt elements 70 extend through the respective side sections 46,58 of the cover plate 44 and the mounting plate 56 and are retained within female bolt elements 72 extending through the respective side sections 48,60 of the cover plate 44 and the mounting plate 56. The bolt elements 68 thereby compress the cover plate 44 into engagement with the mounting plate 56 for releasable securement of the adapter to the door 20.

To brace the cover plate 44 in covering disposition to the cavity 36, the door 20 further includes first and second abutment protuberances comprising U-shaped channels which engage and further support the cover plate 44 at opposed ends of the intermediate section 50 thereof. Specifically, an upper protuberance 74 is mounted to the inner surface of the door 20 adjacent an upper area of the cavity 36 adjacent the side wall 32 to extend parallel to the side wall 32 downward into the cavity 36. A similarly disposed lower protuberance 76 is mounted to the inner surface of the door 20 adjacent the lower area of the cavity 36 adjacent the side wall 32 to extend parallel to the side wall upward into the cavity 36. Each protuberance 74,76 is mounted by way of an anchor member 78 comprising another U-shaped channel and two shimming pieces 80,82. Each anchor member 78 conforms in dimension to the U-shaped cross-section of the side edge 34 of the door 20 and is welded in such conforming abutment to the inner surface of the walls 28,30,32 of the door. Shimming piece 80 is welded to a side section of the anchor member 78 to offset the protuberance 74 slightly toward wall 28 of the door 20, and shimming piece 82 is welded to an intermediate section of the anchor member 78 to displace the protuberance 74 away from the side wall 32. Consequently, when the cover plate 44 is secured to the mounting plate 56 of the door 20, the upper and lower inner surfaces of the intermediate section 50 of the cover plate 44 respectively abut the upper and lower protuberances 74,76 which conform to and snuggly fit within the U-shaped channel defined by the cover plate 44.

The conformed fit of the cover plate 44 with and support thereof provided by the mounting plate 56 and the upper and lower protuberances 74,76 serves to eliminate any freedom of movement of the cover plate 44 and results in a continuity (or relatively flush disposition) of the surfaces of the outer walls 28,30,32 of the door 20 providing an aesthetically pleasing appearance. Furthermore, this rigid securement of the cover plate 44 satisfies all required industry impact specifications for a prison door arrangement.

Figure 6:
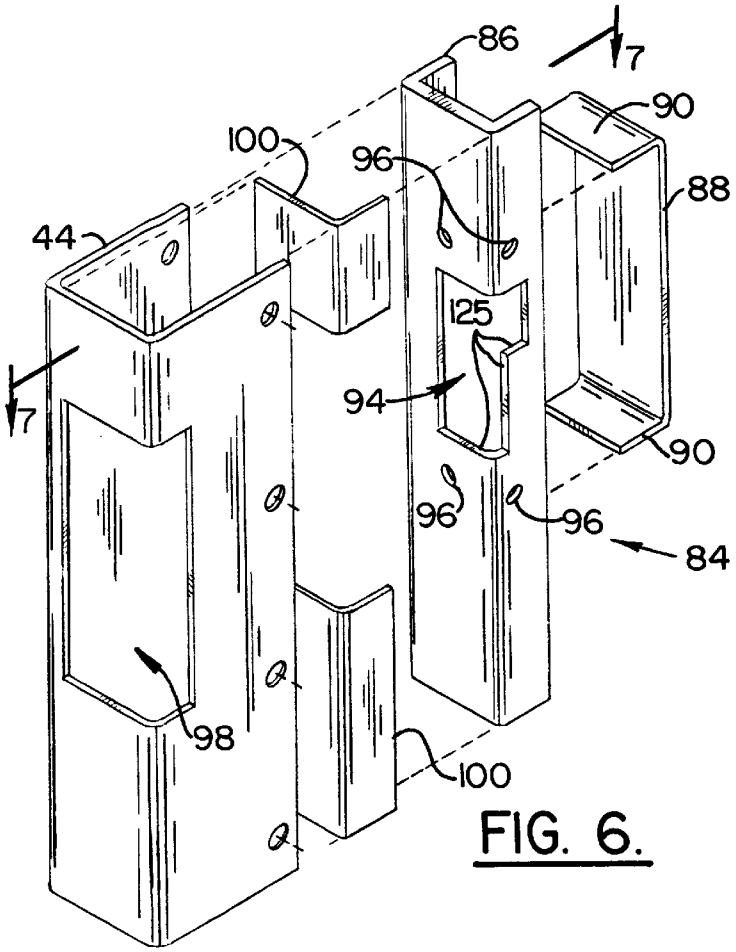
FIG. 6 is an exploded perspective view of the adapter of the insert of FIG. 2.
Figure 9:
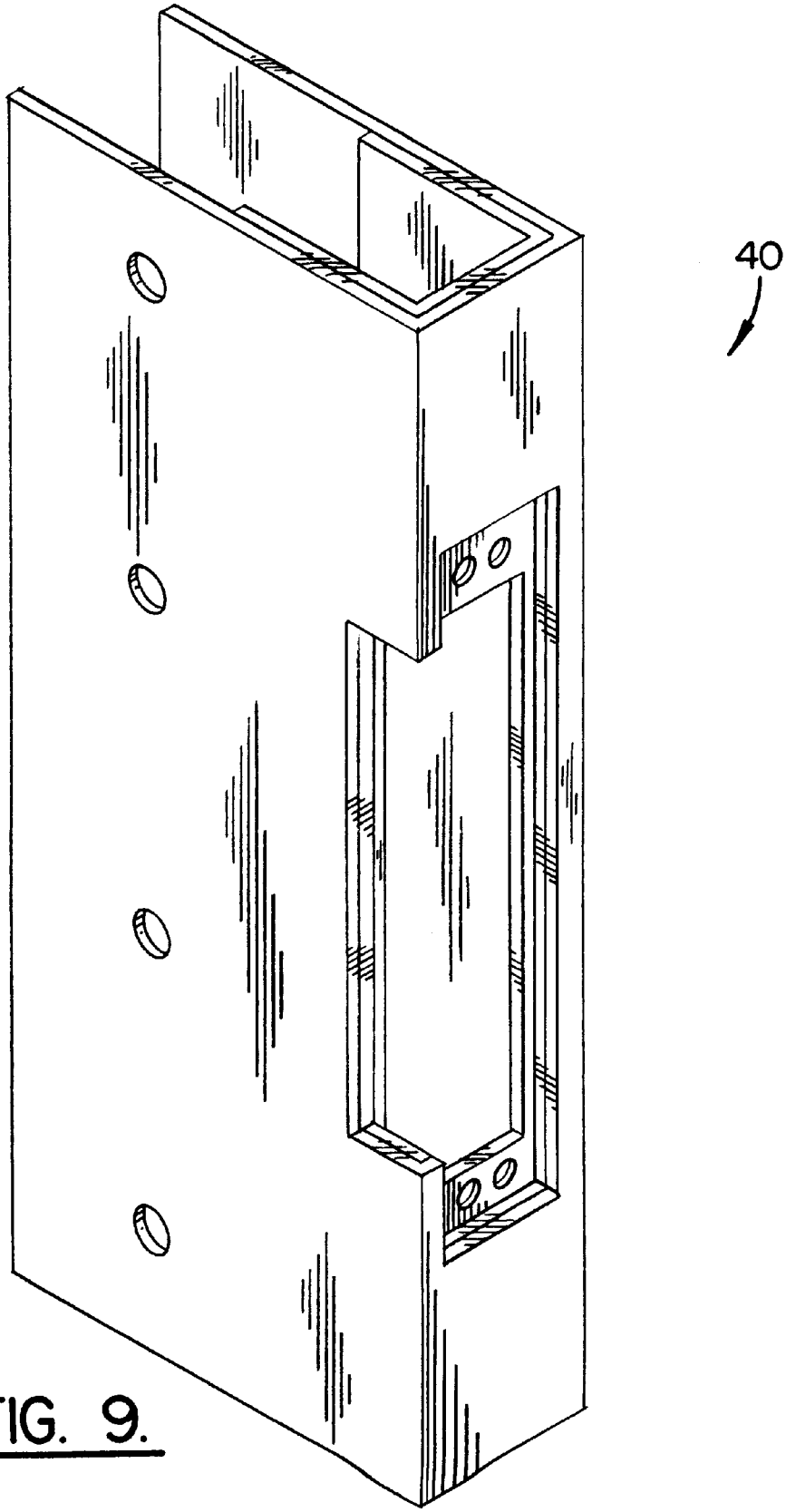
FIG. 9 is a perspective view of an alternative embodiment of the adapter of the present invention.
Figure 10:
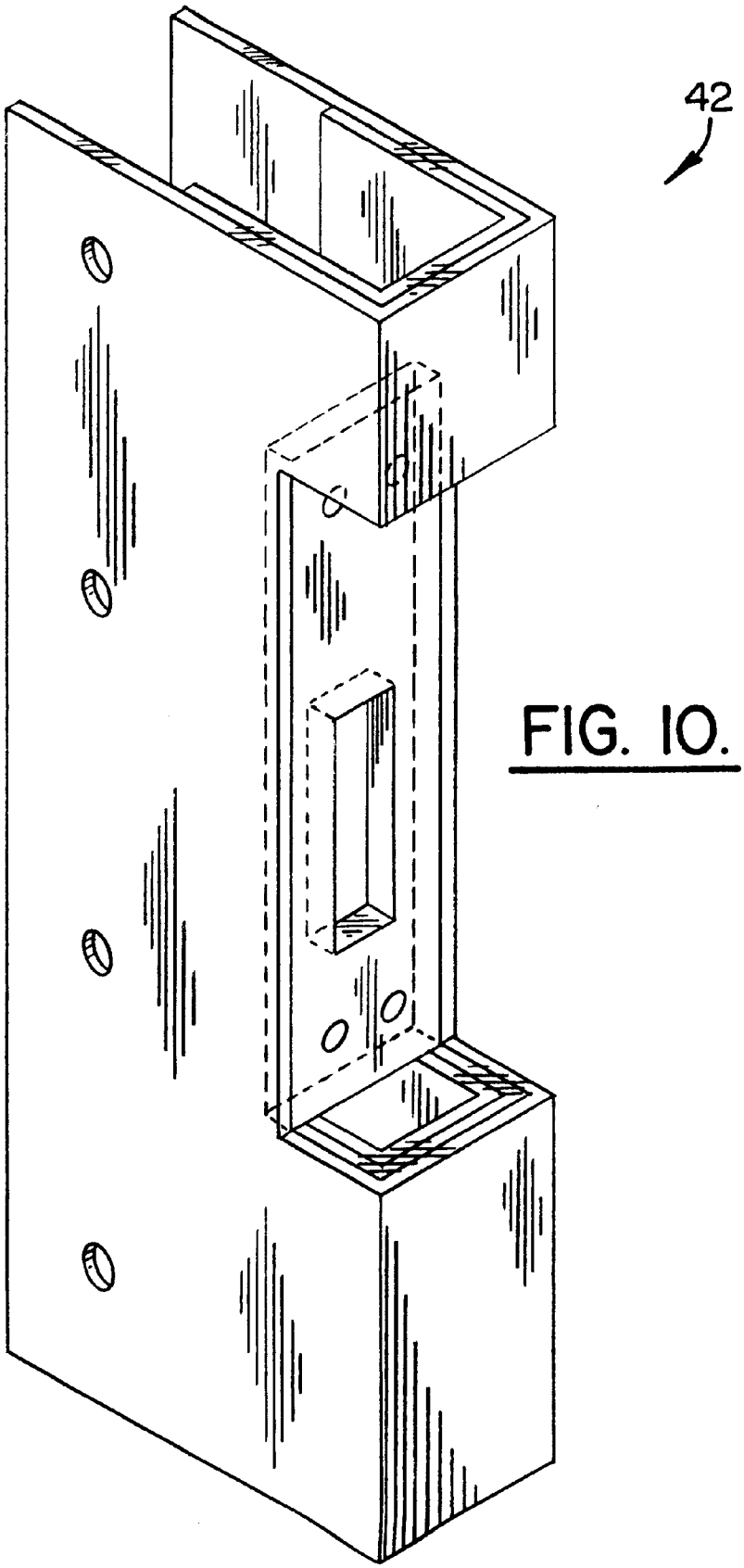
FIG. 10 is a perspective view of yet another alternative embodiment of the adapter of the present invention.

In addition to the cover plate 44, by which the adapter is releasably secured to the door 20, the adapter also includes in combination therewith a strike housing comprising a tubular mounting member 84 (see FIG. 6). The tubular mounting member 84 itself comprises a U-shaped channel member 86 dimensioned generally to conform to and snuggly fit within the channel 52 formed by the cover plate 44, and a U-shaped bracket 88 having ends 90 welded to the inner surface of the U-shaped channel member 86 to define an enclosure 92. The U-shaped channel member 86 further includes an opening 94 comprising a cutout formed in an intermediate and side section thereof and threaded apertures 96 disposed about the opening 94. The cover plate 44 includes an opening 98 in the intermediate section 50.

Figure 7:
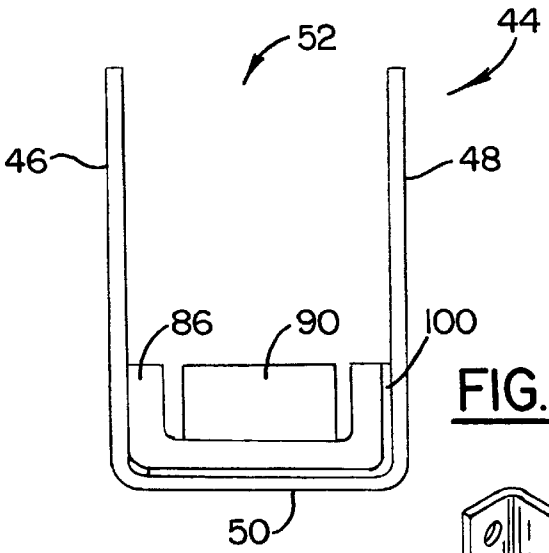
FIG. 7 is a plan view in cross-section of the adapter of FIG. 6 taken along the line 7—7.
Figure 8:
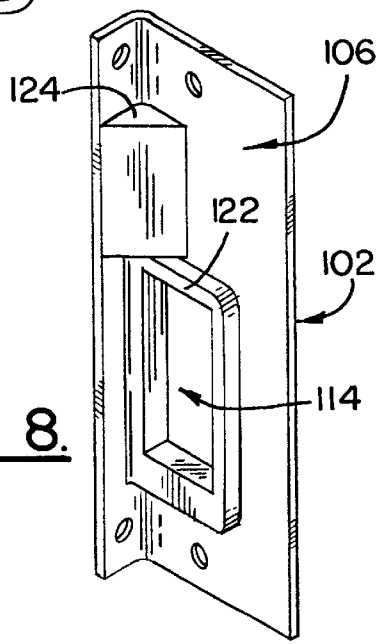
FIG. 8. is a perspective view of the back of the strike of the insert of FIG. 2.

The particular attachment of the tubular mounting member 84 to the cover plate 44 includes two shimming pieces 100 each in the shape of an angle iron. Each shimming piece 100 is welded between and to the inner surface of the cover plate 44 and the U-shaped channel member 84 on opposite sides of opening 98 as shown in FIG. 7. In particular, the edges of each shimming piece 100 align with edges of the opening 98 in the cover plate 44.

When properly attached, the tubular mounting member 84 extends across and blocks the opening 98 formed in the cover plate 44, with the opening 94 in the tubular mounting member 84 being exposed through the opening 98 in the cover plate 44.

As set forth at the outset, the strike 102 itself is conventional and includes a cover plate portion 104 and a rear portion 106. The cover plate portion 104 includes intersecting surfaces 108,110 which merge coplanar with and maintain the continuity (or relatively flush disposition) of the surfaces of the cover plate 44 as shown at 112 in FIG. 4. Furthermore, the cover plate portion 104 includes an opening 114 in communication with the enclosed space 92 of the tubular mounting member 84 into which a bolt of a locking mechanism is inserted by passing through the three aligned openings 114,98,94. The cover plate portion 104 also includes an inclined area 116 extending between the intersecting surfaces 108,110 for guidance of a roller block of a locking mechanism. Screw fasteners 118 extend through apertures 120 in the intersecting surfaces 108,110 and into threading engagement with the apertures 96 in the tubular mounting member 84 to releasably secure the strike 102 to the adapter. The strike 102 is supported in this disposition by the extension of its rear portion 106 through the opening 94 in the tubular mounting member 84 whereby a raised edge 122 of the opening 114 and a back portion 124 of the inclined surface 116 abut the edge 125 of the opening 94 in the tubular mounting member 84.

As will now be apparent, a door arrangement of the present invention can be purchased and installed during construction of a prison facility prior to the selection of any particular strike, thereby facilitating construction of the facility under certain circumstances. Then, when a strike is selected, an adapter designed for the particular strike selected can be obtained for proper securement of the strike within cavity of the door of the door arrangement.

The conventional strike 102 for which the adapter is utilized to form the insert 38 is representative of a FOLGER ADAM strike and a SOUTHERN STEEL strike. For examples of other embodiments of the present invention, reference is had to FIGS. 9 and 10 wherein adapters 40,42 are illustrated which respectively utilize the RR BRINK strike and the AIRTEQ strike.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor to be construed to limit the present invention or otherwise to exclude any such other embodiments, adaptations, variations, modifications and equivalent arrangements, the present invention being limited only by the claims appended hereto and the equivalents thereof.

What is claimed is:

1. A door arrangement including two components comprising a door and a door frame:

(a) wherein a first of said components includes, (i) a cavity formed in a side edge thereof, said side edge comprising opposed walls and a side wall disposed therebetween, said cavity comprising a recess formed in said opposed walls and side wall, (ii) an adapter including a cover plate corresponding to said recess and releasably secured to said first component and extending within said cavity such that continuity of said opposed walls and said side wall of said first component is maintained between an outer surface of said adapter and said opposed walls and said side wall, said cover plate further defining an opening therein, and (iii) a strike disposed within said cavity and releasably secured to said adapter, said strike including a cover plate portion extending within said opening in said cover plate such that continuity of said cover plate is maintained between an outer surface of said cover plate portion and said cover plate, said cover plate portion including an opening therein for receipt therethrough of a bolt of a locking mechanism; and (b) wherein a second of said components includes a locking mechanism having a bolt that moves between a fist position extending through said opening in said cover plate portion of said strike for locking of said door arrangement, and a second position retracted from said opening in said cover plate portion of said strike for unlocking of said door arrangement.

2. A door arrangement according to claim 1, wherein said cover plate defines a U-shaped channel.

3. A door arrangement according to claim 1, wherein said strike includes a surface inclined to said opposed walls and said side wall of said side edge of the first component for engagement with and forced retraction of the bolt during closing of the door, said inclined surface disposed proximate said opening in said strike through which said bolt extends in said first position.

4. A door arrangement according to claim 1, wherein said adapter includes a strike mounting member to which said strike is releasably secured.

5. A door arrangement according to claim 4, wherein said strike mounting member extends across said opening in said cover plate and further includes an opening through which a portion of said strike extends.

6. A door arrangement according to claim 5, wherein said cover plate portion of said strike includes apertures through which fasteners extend to secure said strike to said strike mounting member of said adapter.

7. A door arrangement according to claim 1, wherein said first component further comprises a cover plate mounting member attached thereto and extending within said cavity, said cover plate including opposed side sections extending in abutment with said cover plate mounting member.

8. A door arrangement according to claim 7, wherein releasable fasteners extend through said cover plate and said cover plate mounting member to releasably secure said adapter to said door.

9. A door arrangement according to claim 1, wherein said first component further comprises a protuberance attached to said side wall and extending partially into said cavity parallel to said opposed walls and said side wall of said first component, and wherein said cover plate defines a U-shaped channel, said protuberance extending partially into said cavity in abutment with an inner surface of said U-shaped channel in bracing support of said cover plate.

10. A door arrangement according to claim 9, wherein said protuberance comprises a U-shaped channel and represents an extension of said side edge of said first component.

11. A door arrangement according to claim 9, wherein said first component further comprises a cover plate mounting member attached thereto and extending within said cavity, said cover plate including opposed side sections extending in abutment with said cover plate mounting member.

12. A door arrangement according to claim 11, wherein releasable fasteners extend through said cover plate and said cover plate mounting member to releasably secure said adapter to said door.

13. A door arrangement according to claim 11, wherein said cover plate mounting member comprises a U-shaped mounting plate.

14. A door arrangement according to claim 13, wherein said U-shaped mounting plate includes opposed sections and an intermediate section, said intermediate section extending across said cavity parallel to said side wall to define a back wall of said cavity, said side sections being attached to said side walls of said first component.

15. A door arrangement including two components comprising a door and a door frame, wherein a first of said component includes:

(a) a cavity formed in a side edge thereof, said side edge comprising opposed walls and a side wall disposed therebetween defining a U-shaped channel, said cavity comprising a portion cutout of said opposed walls and side wall opening into said U-shaped channel;

(b) a U-shaped cover plate corresponding to said cutout portion releasably secured to said first component and extending within said cavity such that continuity of said opposed walls and said side wall is maintained between an outer surface of said cover plate and said opposed walls and said side wall; and (c) a strike disposed within said cavity and releasably secured to said cover plate.

16. A door arrangement including two components comprising a door and a door frame, wherein a first of said component includes:

(a) a cavity formed in a side edge of thereof, said side edge comprising opposed walls and a side wall disposed therebetween defining a U-shaped channel, said cavity comprising a portion cutout of said opposed walls and side wall opening into said U-shaped channel;

(b) an adapter including, (i) a U-shaped cover plate corresponding to said cutout portion releasably secured to the said first component and extending within said cavity, said cover plate defining an opening therein, and (ii) a strike mounting member secured to said cover plate and extending across said opening in said cover plate, said strike mounting member including an opening therein; and (c) a strike disposed within said cavity and including a portion extending within said opening in said strike mounting member and a cover plate portion releasably secured to said strike mounting member within said opening in said cover plate, said strike being disposed relative to said cover plate such that continuity of said cover plate is maintained between an outer surface of said cover plate portion of said strike and said cover plate.

17. A door arrangement including two components comprising a door and a door frame, wherein a first of said component includes:

(a) a cavity formed in a side edge of thereof, said side edge comprising opposed walls and a side wall disposed therebetween defining a U-shaped channel, said cavity comprising a portion cutout of said opposed walls and side wall opening into said U-shaped channel;

(b) a cover plate forming a U-shaped channel releasably secured to said first component and extending within said cavity;

(c) a strike disposed within said cavity and releasably secured to said cover plate; and (d) a protuberance attached to said side wall and extending partially into said cavity parallel to said opposed wall and said side wall of said first component, said protuberance extending partially into said cavity in abutment with an inner surface of said U-shaped channel of said cover plate for bracing support thereof.

* * * * *